US007417519B2

(12) United States Patent
Miller

(10) Patent No.: US 7,417,519 B2
(45) Date of Patent: Aug. 26, 2008

(54) EMERGENCY STOP RELAY COMBINATION

(75) Inventor: James Peter Miller, Waukesha, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 324 days.

(21) Appl. No.: 10/955,458

(22) Filed: Sep. 30, 2004

(65) Prior Publication Data

US 2006/0066427 A1 Mar. 30, 2006

(51) Int. Cl.
*H01H 3/00* (2006.01)

(52) U.S. Cl. ..... 335/186; 335/185

(58) Field of Classification Search ..... 335/185, 335/186

See application file for complete search history.

(56) References Cited

U.S. PATENT DOCUMENTS 4,495,538 A 1/1985 Thomas
5,526,256 A * 6/1996 Sakata et al. ..... 700/79
5,559,438 A * 9/1996 Bedouet et al. ..... 324/418
5,689,398 A 11/1997 Miller et al.
6,272,001 B1 * 8/2001 Futsuhara ..... 361/170
6,301,091 B1 * 10/2001 Zomchek et al. ..... 361/189
6,304,189 B1 * 10/2001 Koch et al. ..... 340/664
6,686,672 B2 * 2/2004 Brown et al. ..... 307/125
6,734,581 B1 * 5/2004 Griffis ..... 307/125
6,882,155 B2 * 4/2005 Lazzaro ..... 324/418

* cited by examiner

*Primary Examiner*—Elvin Enad
*Assistant Examiner*—Bernard Rojas
(74) *Attorney, Agent, or Firm*—Quarles & Brady LLP; Alexander R. Kuszewski

(57) ABSTRACT

A switching apparatus and method, the apparatus comprising a relay including a relay coil and at least one normally open relay contactor that closes when the relay coil is energized, a normally closed stop contactor and a stop member moveable between a deactivated position in which the stop contactor is closed and an activated position wherein the stop member forces each of the stop contactor and the relay contactor open.

22 Claims, 7 Drawing Sheets

EMERGENCY STOP RELAY COMBINATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The field of the invention is power controls and more specifically emergency stop and safety relay controls for use with power equipment.

This section of this document is intended to introduce various aspects of art that may be related to various aspects of the present invention described and/or claimed below. This section provides background information to facilitate a better understanding of the various aspects of the present invention. It should be understood that the statements in this section of this document are to be read in this light, and not as admissions of prior art.

In many industrial systems, high levels of power are required by loads (e.g., manufacturing equipment, HVAC systems, etc.). Power relays are commonly employed to link and de-link power sources to and from loads, respectively. A typical power relay includes a coil and a plurality (e.g., four) of contact pairs or contactors where each contact contactor is either normally open (NO) or normally closed (NC) and changes its state (e.g., open or closed) when the coil is excited. In the case of a relay used with three phase power lines, the relay typically includes at least three NO contactors that close when an associated coil is energized and open when the coil is de-energized. In the case of an NO contactor, a relay spring usually biases the contactors into the normally open state. Typically the force applied by the spring to the contactors upon de-energization of the coil is on the order of one-fourth to one-half pound.

In addition to the components above, most high power control configurations also include several other components. To this end, a typical control configuration will include a start button and associated NO contactor, an emergency stop (ES) button and associated NC contactor and a fourth normally open power relay contactor (i.e., a fourth normally open contactor that opens and closes when the power relay is de-energized and energized, respectively) where the start and ES contactors are in series with the power relay coil and the fourth NO contactor is in parallel with the start contactor. In this case, to provide power to the load, the start button is pressed to close the NO start contactor thereby providing power through the ES contactor to the power relay coil which causes the power contactors in the power lines as well as the power contactor in parallel with the start contactor to close. When the start button is released, the parallel contactor remains closed so that the relay coil remains energized and the NO contactors remain closed.

If a problem occurs, a system operator can quickly cut off power to the load by simply pressing the ES button to open the ES contactor which cuts off power to the power relay coil and in turn, at least in theory, should open the NO relay contactors in the power lines as well as the NO contactor that is in parallel with the start button. Here, the force applied by the ES button to the ES contact pair is relatively large (e.g., on the order of 10 to 50 pounds, depending on the force applied by the system user when the ES button is pressed).

Unfortunately, as well known in the industry, despite cutting off power to the relay coil by pressing an ES button, under certain circumstances, the power relay contactors have been known to remain closed due to mechanical failure, heating/welding of contact pairs, residual magnetism within the relay structure, relay corrosion, frictional forces or a combination of the above. Hereinafter, in the interest of simplifying this explanation, the term "failed" will be used to refer to any NO contactor that remains closed when an associated relay coil is de-energized. Where any contactor in a relay fails, all of the NO contactors within a relay remain in the closed state. When the NO power line contactors fail, a load becomes uncontrollable as the system operator has no way to cut off power to the load.

To reduce the likelihood of uncontrollable loads, it has become common practice within the industry to design redundant power control configurations. For instance, one common redundant relay configuration includes two power relays where the relay coils are arranges in series with the NC ES contactor and the NO start contactor, a separate NO contactor from each of the two relays is arranged in series in each of the three power supply lines and an arrangement including series linked NO contactors from each of the relays is arranged in parallel with the NO start contactor. In this case, when a power relay contactor in the first relay fails (e.g., welds, sticks closed, etc.), in most cases the contactors in the second relay will remain operational and the load will remain controllable. Thus, even when one relay fails, when the NC ES button is pressed, the NO power line contactors in the second relay should open and cut off power to the load.

To better ensure redundancy, circuits have been developed that preclude providing power to a load after a relay fails until after the failure is eliminated via either manipulation of the relay or replacement of the relay. For instance, where corrosion causes a contactor to stick in the closed position, some times the contactor can be reopened by cycling through energizing and de-energizing cycles in an effort to overcome the binding effect of the corrosion. Where the spring force is insufficient to separate the NO relay contactors (e.g., in most cases where contacts weld together), the entire relay typically has to be replaced. While redundant relay designs and replacement relays are a solutions to the uncontrolled load and failure problems described above, unfortunately, these solutions are relatively expensive for several reasons. To this end, redundant relay designs require additional relay hardware which increases design and implementation costs. In addition, when the relay spring force fails to open NO contactors during energizing cycles and a relay has to be replaced, the replacement costs include loss of productivity due to down time of equipment linked to the power lines associated with the relay and maintenance costs (e.g., a system operators time) in addition to the cost of the replacement relay.

Moreover, in at least some cases conditions can occur wherein even redundant relay configurations fail to cut off load power when an ES button is pressed. For instance, when a large unexpected current surge passes through power lines it is possible for both series NO power line relay contactors in each power line to fail (e.g., weld) such that the ES button becomes effectively useless.

Therefore, it would be advantageous to have an inexpensive power control configuration wherein power to loads could be cut off despite the operational condition of line relays and where failed relays could be salvaged whenever possible despite contactor failure.

BRIEF SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

It has been recognized that in many cases NO contactors that remain closed for some reason after an associated relay coil is de-energized, would open if more force (e.g., 5 pounds instead of a half a pound applied by a typical relay spring) were applied to the NO contactors. Thus, in many cases relays are replaced despite the fact that the relay contactors are still in condition to operate effectively—the only problem being that the NO relay contactors will not open under the applied spring force.

It has also been recognized that where contactors fail due to welding or the like, the contactors may still be opened if sufficient force (e.g. 5-10 pounds) is applied thereto. Moreover, it has been recognized that the force applied to an emergency stop button typically is on the order of five or more pounds.

Based on the above realizations, it has been recognized that a new type of hybrid emergency stop/relay device can be configured wherein an emergency stop button can be used to manually and mechanically open both a normally closed emergency stop contactor and normally open relay coils. Here, the relatively large five or more pound force applied to the emergency stop button is, in addition to being applied to the emergency stop contactor, applied to the relay contactors thereby opening the relay contactors irrespective of whether or not the contactors are stuck in the closed state.

Consistent with the above comments, at least some embodiments of the invention include a switching apparatus comprising a relay including a relay coil and at least one normally open relay contactor that closes when the relay coil is energized, a normally closed stop contactor and a stop member moveable between a deactivated position in which the stop contactor is closed and an activated position wherein the stop member forces each of the stop contactor and the relay contactor open.

In some cases the relay contactor is a first relay contactor and the relay includes at least a second normally open relay contactor. In some cases the relay includes third and fourth normally open relay contactors.

Some embodiments further include a housing forming a cavity and the relay and the stop contactor are mounted within the cavity. In at least some cases the housing forms an opening and the stop member includes a distal end that extends from the opening, when the distal end is pressed, the stop member moving form the deactivated position to the activated position. In some cases the distal end forms a button surface. In some cases the stop contactor is linked in series with the relay coil.

In some cases the apparatus is for use with a power supply, a load and a start assembly, the apparatus for controlling power provided by the supply to the load via at least one power line, the start assembly including a start member and a normally open start contactor, the first relay contactor linked within the at least one power line between the source and the load, the stop contactor linked in series with the start contactor and the second relay contactor linked in parallel with the start contactor. More specifically, in some cases the apparatus is for use with a three phase load and a three phase source where each load phase is linked to a separate one of the supply phases via a unique power line, the relay further including third and fourth normally open power contactors linked within the second and third power lines between the source and the load, respectively.

In at least some cases the relay is a first relay and the apparatus further includes a second relay including a second relay coil and at least one normally open second relay contactor that closes when the second relay coil is energized, the stop member, when moved to the activated position, also forcing the second relay contactor open.

In some embodiments the relay includes an armature that moves along an activation axis when the coil is energized and de-energized, the at least one relay contact linked to the armature to move therewith between the closed and open states, the stop member including a proximal end that bears against at least one of the armature and the stop contact when in the activated position. In some cases the proximal end of the stop member bears against the armature when the stop member is in the activated position. In some cases the stop member includes a coupler that engages the stop contact when the stop member is in the activated position. In some cases the stop member includes a distal end opposite the proximal end and the stop contactor is positioned between the distal end and the relay.

Other embodiments include an assembly for use with a power supply and a load, the assembly for controlling power provided by the supply to the load via at least one supply line, the assembly comprising a relay including a relay coil and at least a first normally open relay contactor that closes when the relay coil is excited, the relay contactor positioned within the line between the source and the load, a normally closed stop contactor in series with the relay coil and a stop member moveable between a deactivated position in which the stop contactor is closed and an activated position wherein the stop member forces each of the stop contactor and the relay contactor open.

Some embodiments include a switching apparatus comprising a rigid support structure, a relay mounted within the support structure, the relay including a relay coil, an armature and at least one normally open relay contactor, the contactor including at least one moveable contact and one stationary contact, the moveable contact mounted for movement to the armature, the armature and moveable contact moving between a de-energized position and an energized position along an armature axis when the coil is energized and de-energized, respectively, the moveable contact closed with the stationary contact when the armature is in the energized position, a normally closed stop contactor mounted within the support structure, the stop contactor including at least one moveable contact and at least one stationary contact and a stop button mounted to the support structure for movement between an activated position and a deactivated position along a stop axis that is substantially parallel to the armature axis, the stop button operably juxtaposed with respect to each of the stop contactor and the armature such that when the stop button is activated, the stop button opens each of the stop contactor and the normally open relay contactor.

Still other embodiments include a switching apparatus comprising a relay including a relay coil and at least one normally open relay contactor that closes when the relay coil is energized and a manual open button moveable between a deactivated position in which the button is de-linked from the relay contactor and an activated position wherein the button forces the relay contactor open. Here, in some cases the apparatus will further include a housing that forms a cavity and at least one opening into the cavity, the relay mounted within the cavity and the button mounted within the opening.

The invention also includes a method for cutting off power from a source to a load when a stop button is activated, the method comprising the steps of providing a normally closed emergency stop contactor that is mechanically linked to the stop button such that when the stop button is activated, the stop contactor is opened and providing a relay including a coil in series with the stop contactor and at least one relay contactor in series between the source and the load wherein the contactor is mechanically linked to the stop button such that when the stop button is activated, the relay contactor is opened.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

Figure 1:
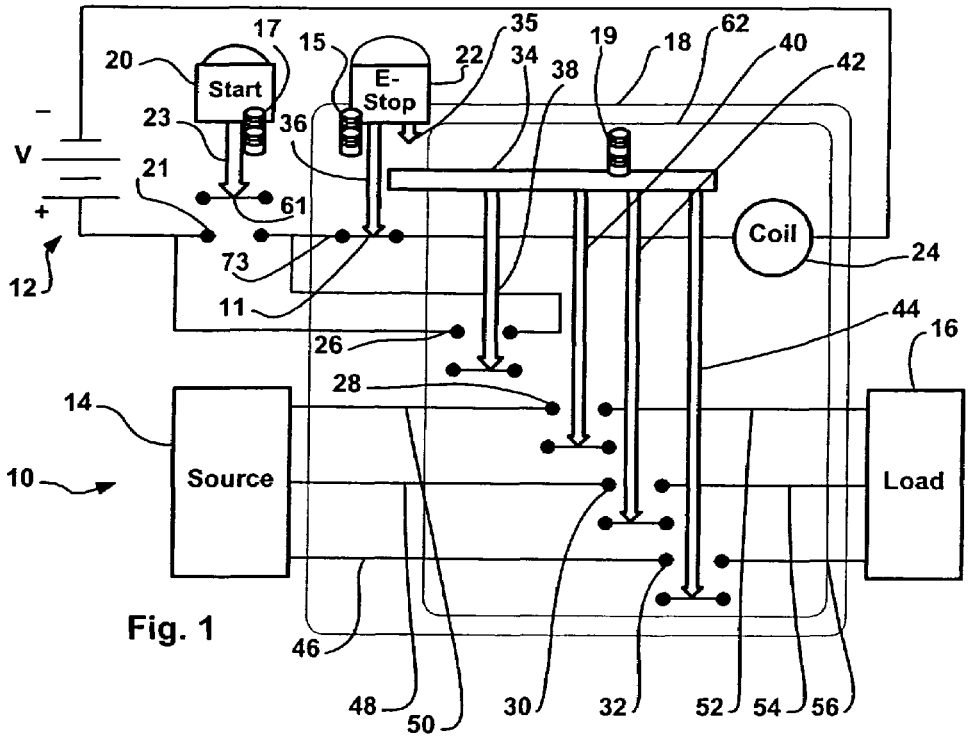
FIG. 1 is a schematic diagram illustrating a system including an emergency stop/relay module according to at least some aspects of the present invention wherein components are in normal states when a relay coil is deenergized.

While the present invention may be embodied in any of several different forms, the present invention is described here with the understanding that the present disclosure is to be considered as setting forth an exemplification of the present invention which is not intended to limit the invention to the specific embodiment(s) illustrated.

Referring now to the drawings wherein like reference numerals correspond to similar elements throughout the several views and, more specifically, referring to FIG. 1 the present invention will be described in the context of an exemplary power control system 10 including a control voltage source 12, a three-phase voltage source 14, a load 16, a start button 20 and associated start contactor 21 and an emergency stop/relay module 18. As its label implies, source 14 provides three-phase voltages on three supply lines 46, 48 and 50 to module 18 which controls three-phase output voltages provided to load 16 on lines 52, 54 and 56. To this end, module 18 includes emergency stop button 22 and an associated emergency stop contactor 73 and a relay 62.

Herein, each of contactor 73 and other contactors includes stationary and moveable contacts where, as the labels imply, moveable contacts are moved with respect to the stationary contacts to open or close an associated contactor. Thus, for instance, contactor 73 includes a moveable contact 11 (or moveable contact sub-assembly) that moves with respect to stationary contacts (not separately labeled) to open and close contactor 73. Similarly, start contactor 21 includes moveable contact 61 that moves with respect to stationary contacts (not separately labeled) to open and close contactor 21.

Emergency stop button 22 includes a button spring 15 and, for illustrative purposes only, two extension members 35 and 36 that extend into a housing that accommodates other module components. The button spring 15 biases button 20 out of the housing and into a released position. The proximal end of extension member 36 is mechanically linked to the movable contact 11 associated with normally closed contactor 73 so that contact 11 moves along with button 22 (i.e., when spring 15 forces button 22 into the released position illustrated in FIG. 1, moveable contact 11 follows button 22 and is closed and, when button 22 is pressed, movable contact 11 is forced open (see FIG. 3)).

Referring still to FIG. 1, relay 18 includes four normally open contactors 26, 28, 30 and 32, an armature or yoke identified by numerals 34, 34*a*, 34*b*, 34*c* and 34*d* and a coil 24. Hereinafter, unless indicated otherwise, the relay armature will be identified by numeral 34. As well known in the industry, armature 34 is mechanically linked to the movable contacts (not separately labeled) of each of the normally open contactors 26, 28, 30 and 32 so that the moveable contacts associated with contactors 26, 38, 30 and 32 move with armature 34. These mechanical linkages between the armature and the movable contacts are schematically represented by armature extensions 38, 40, 42 and 44.

Figure 2:
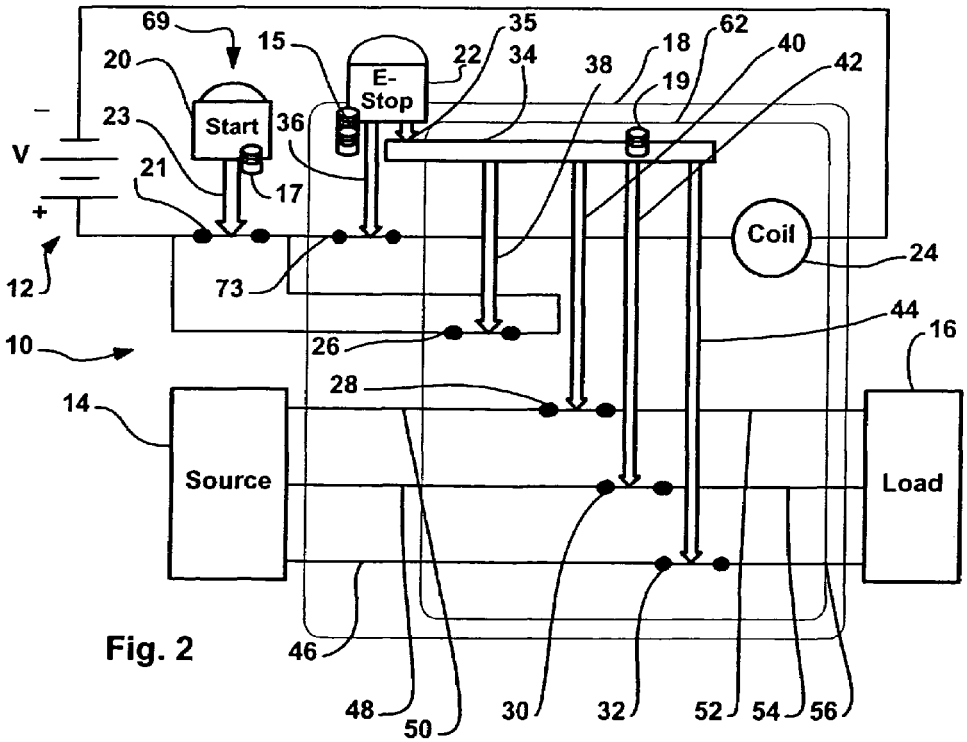
FIG. 2 is similar to FIG. 1, albeit illustrating the components when a start button is pressed and the relay coil is energized.

Armature 34 can assume two different steady-state positions. First, as illustrated in FIG. 1, armature 34 may be in a de-energized position where each of the normally open contactors 26, 28, 30 and 32 is open. Second, as illustrated in FIG. 2, armature 34 may be in an energized position wherein the armature physically moves within the relay and forces the movable contacts of each of contactors 26, 28, 30 and 32 into a closed state. A spring 19 is provided within relay 62 to bias armature 34 into its de-energized position as illustrated in FIG. 1.

Referring still to FIG. 1, coil 24 is arranged with respect to armature 34 such that, when coil 24 is energized, a magnetic field created thereby causes armature 34 to move from the de-energized position into the energized position. Thus, when coil 24 is energized, armature 34 is forced into the position illustrated in FIG. 2 and each of contactors 26, 28, 30 and 32 is closed. When coil 24 is de-energized, spring 19 forces armature 34 into the deactivated position illustrated in FIG. 1.

Referring again still to FIG. 1, to control three-phase power to load 16, each of normally open relay contactors 28, 30 and 32 is placed in series with a separate one of the three load phases. Thus, for instance, contactor 28 is placed in series between source supply line 50 and load supply line 52. Similarly, contactors 30 and 32 are placed in series between lines 48 and 54 and between lines 46 and 56, respectively. When contactors 28, 30 and 32 are closed, power is provided from source 14 to load 16 via lines 52, 54 and 56 and when contactors 28, 30 and 32 are open power is cut off from load 16.

Referring to still FIG. 1, start button 20 is mechanically linked via an extension member 23 with a movable contact 61 of normally open start contactor 21. When start button 20 is not pressed, a spring 17 forces button 20 and movable start contact 61 into the open position illustrated in FIG. 1. However, when button 20 is pressed as indicated by arrow 69 in FIG. 2, movable start contact 61 is forced into the closed position.

Referring once again to FIG. 1, start contactor 21 is linked in series with emergency stop contactor 60, coil 24 and control source 12 to form a start-stop circuit. Fourth normally open relay contactor 26 is arranged in parallel with the start contactor 21.

Importantly, under certain circumstances, extension member 35 contacts armature 34 when emergency stop button 22 is pressed. More specifically, when armature 34 is in the energized position as illustrated in FIG. 2, extension member 35 mechanically contacts actuator 34 (see FIG. 2) such that, if energy stop button 22 is pressed, in addition to forcing emergency stop contactor 73 open, the pressing action forces armature 34 from the energized position (see FIG. 2) toward the de-energized position (see FIG. 3).

In operation, referring once again to FIG. 1, prior to providing power to load 16, normally open start contactor 21 is open, normally closed emergency stop contactor 73 is closed, armature 34 is in the de-energized position and each of relay contactors 26, 28, 30 and 32 is open. To provide power to load 16, start button 20 is pressed as indicated by arrow 69 in FIG. 2 thereby closing start contactor 21. When contactor 21 is closed, power is provided from source 12 to coil 24. When power is provided to coil 24, coil 24 is energized which in turn forces armature 34 from the de-energized position illustrated in FIG. 1 into the energized position illustrated in FIG. 2, each of the normally open contactors 26, 28, 30 and 32 is closed and extension member 35 is in contact with armature 34. When button 20 is released, spring 17 forces button 20 into the released state and start contactor 21 opens. However, because relay contactor 26 in parallel with start contractor 21 is now closed, coil 24 remains energized and hence contactors 28, 30 and 32 remain closed thereby providing power to load 16.

Figure 3:
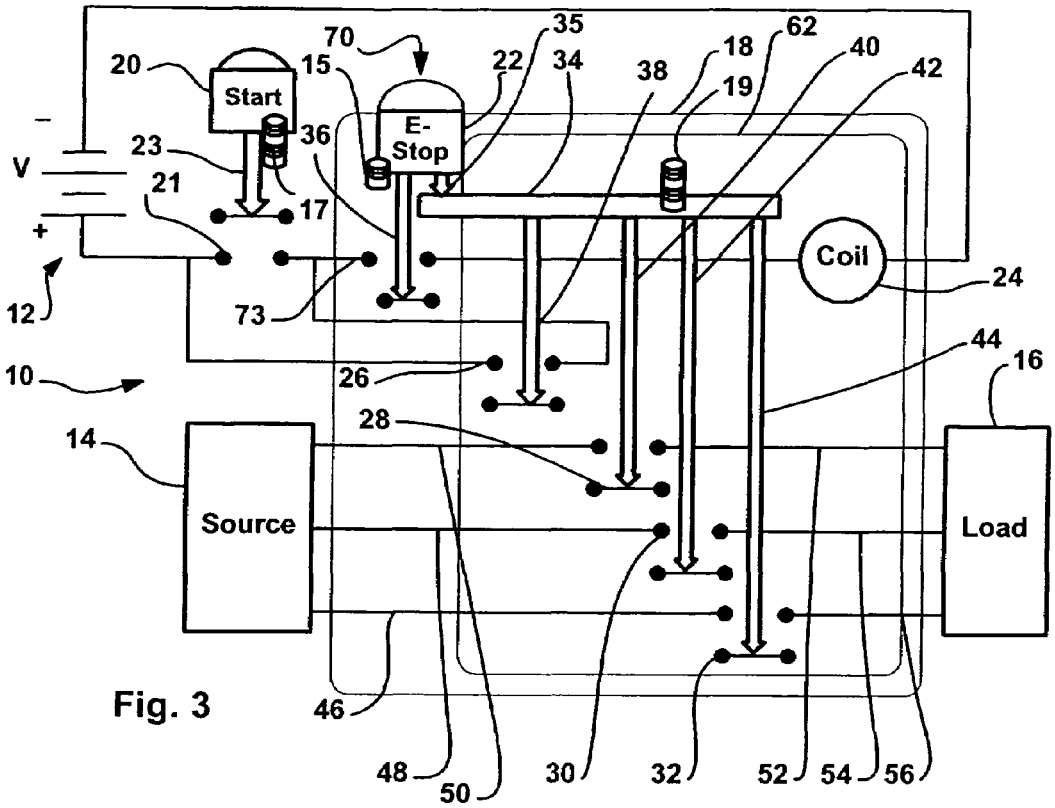
FIG. 3 is similar to FIG. 1, albeit illustrating the components when an emergency stop button is pressed to open both an emergency stop contactor and relay contactors via mechanical force.
Figure 4:
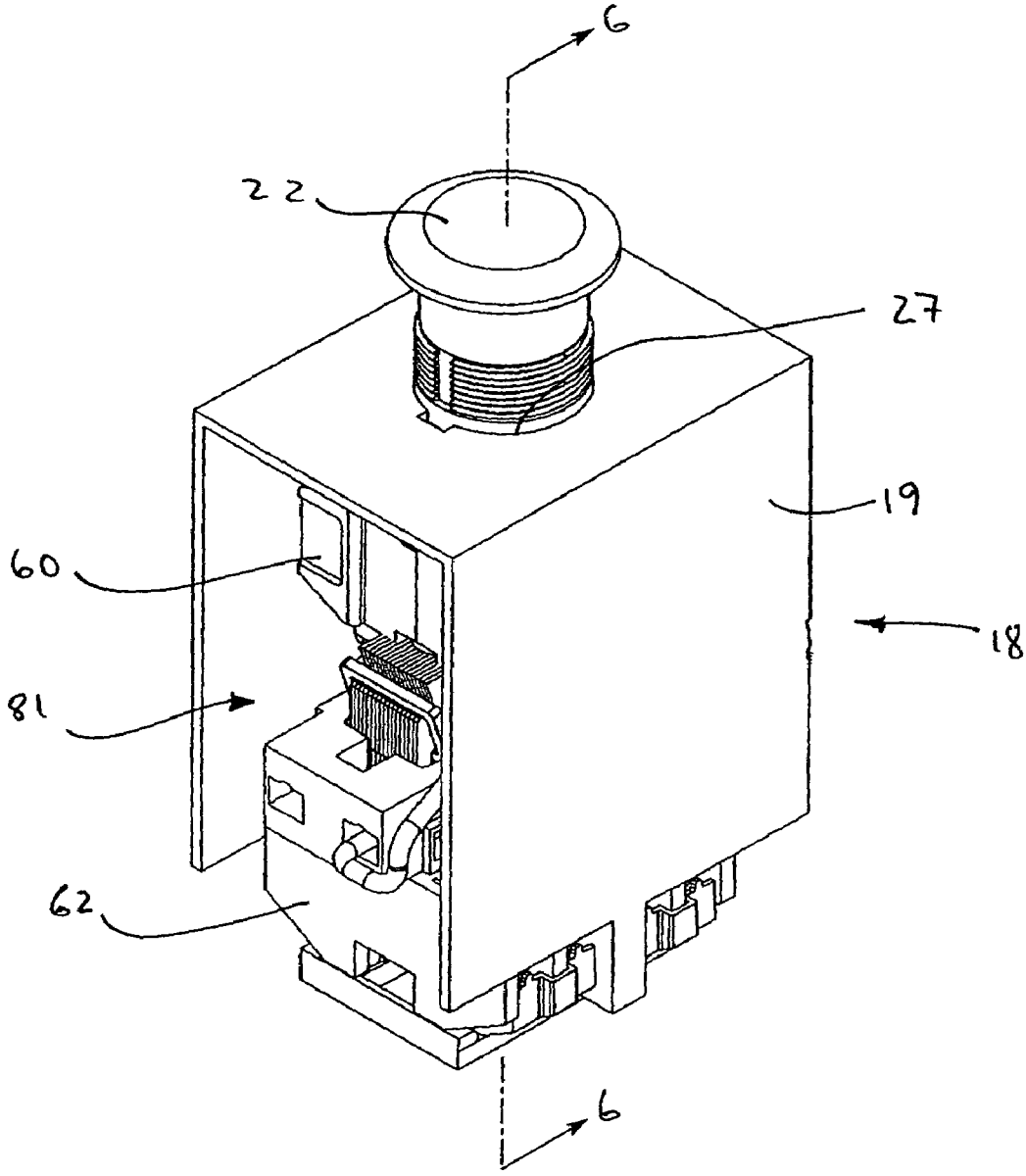
FIG. 4 is a perspective view of an exemplary emergency stop/relay module according to one embodiment of the present invention.
Figure 5:
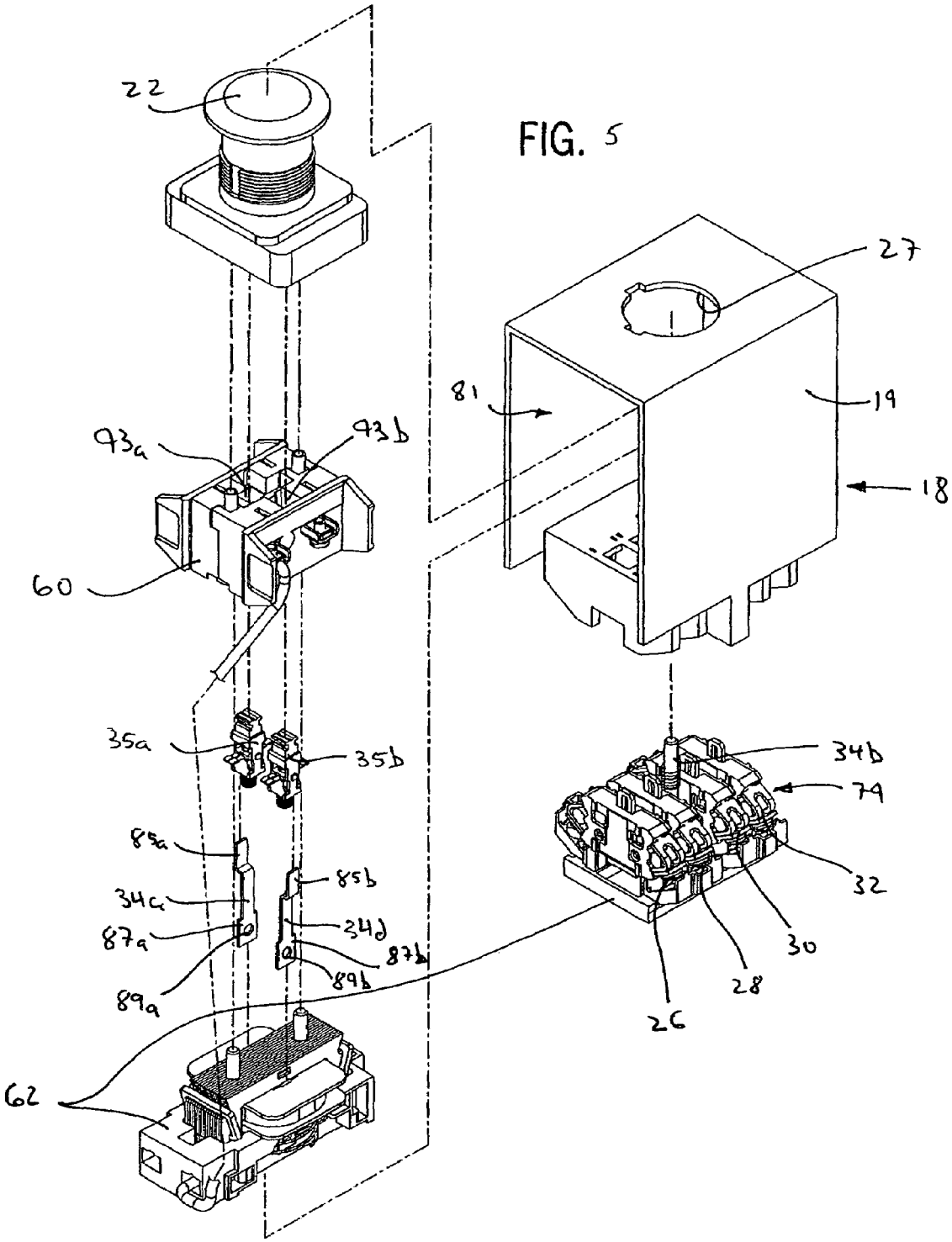
FIG. 5 is an exploded view of the module of FIG. 4.

To quickly cut off power to load 16, referring once again to FIG. 2, emergency stop button 22 is pressed. Referring also to FIG. 3, when button 22 is pressed as indicated by arrow 70, emergency stop contactor 73 is opened thereby momentarily cutting off power to coil 24 and causing coil 24 to be deenergized. When coil 24 is deenergized, in theory, the spring associated with armature 34 should force armature 34 into the deactivated position as illustrated in FIG. 3 wherein contactors 26, 28, 30 and 32 open. Once contactor 26 is open, when stop button 22 is released and spring 15 forces button into the released position thereby closing stop contactor 73, power should still be cut off to coil 24 as neither of the start contactor 21 or relay contactor 26 is closed.

Referring once again to FIG. 2, as described above, in at least some cases, relay contactors 26, 28, 30 and 32 have been known to remain closed even after an emergency stop button 22 has been pressed. In the case of the present invention, sticking or welded relay contactors are forced open by contacting the emergency stop button 22 to armature 34 via extension member 35. Thus, referring again to FIG. 3, when stop button 22 is pressed as indicated by arrow 70, in addition to opening emergency stop contactor 60, the pressing activity mechanically forces armature 34 from the energized position to the de-energized position thereby opening each of relay contactors 26, 28, 30 and 32. Here, where a five or more pound force is applied to button 22 when the button is pressed, a large force is applied to armature 34 which, it has been observed, is sufficient to open stuck or even welded contactors. When button 22 is released, spring 15 again forces button 22 and the mechanically linked moveable contact 11 into the released positions illustrated in FIG. 1. Because extension member 35 is not mechanically linked to armature, when button 22 is forced into the released state, extension member 35 separates from armature 34 (see FIG. 1) and contactors 26, 28, 30 and 32 remain open.

Referring now to FIGS. 4-7, an exemplary emergency stop/relay module 18 consistent with the description above is illustrated. In the exemplary embodiment, module 18 includes a housing 19 that forms a cavity 81 and at least one opening 27 that opens into the cavity 61. A normally closed emergency stop contactor assembly 60, extension members 35*a* and 35*b* and a relay 62 are all mounted within cavity 81. More specifically, button 22 is mounted within opening 27 and emergency stop contactor module 60 is sandwiched between relay 62 and button 22.

Although not illustrated in FIGS. 4-7, contactor module 60 includes stationary and movable contacts and a spring that biases the movable contacts into a normally closed position (see again FIGS. 1-3).

Figure 6:
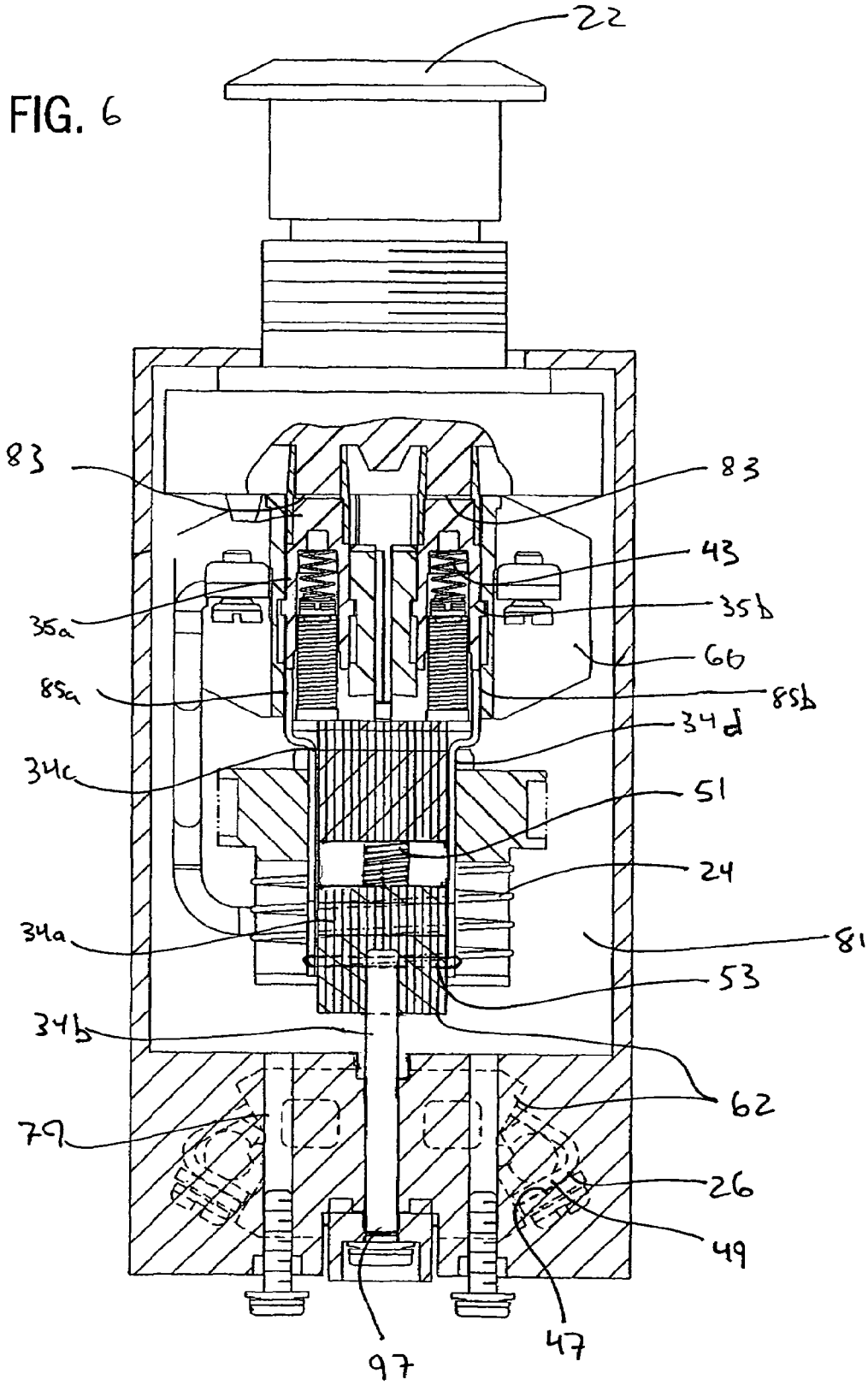
FIG. 6 is a cross-sectional view taken along the line 6-6 of FIG. 4 where components are shown in positions that occur when a relay coil is energized and when an emergency stop button is released.

Referring still to FIG. 6, extension members 35*a* and 35*b* are mounted within openings 93*a* and 93*b* formed by module 60 and are biased against an undersurface 83 of button 22 by springs 43. Thus extension members 35*a* and 35*b* move along with button 22 during operation.

Referring still to FIG. 6, relay 62 includes, among other things, a coil 24, an armature 34, a spring 51 and a contact block 79. Armature 34 includes several components that are rigidly mechanically connected including a magnetic member 34*a*, a plunger 34*b* and armature extensions 34*c* and 34*d*. Each of extensions 34*c* and 34*d* includes an upper end 85*a* and 85*b* that is received in openings formed by module 60 where the openings align each of ends 85*a* and 85*b* with a lower end of one of extension members 35*a* and 35*b*. While ends 85*a* and 85*b* are received in module 60 openings, ends 85*a* and 85*b* are nevertheless able to slide lengthwise within the openings (i.e., along a trajectory parallel to arrow 70 in FIG. 7). Thus when button 22 is pressed and forces members 35*a* and 35*b* downward, force is also applied to drive members 34*c* and 34*d* downward. However, because extensions 34*c* and 34*d* are not mechanically linked to extension member 35*a* and 35*b* when button 22 is released and moved back to the released position, while springs 43 moves extension members 35*a* and 35*b* along with button 22, extensions 34*c* and 34*d* do not automatically follow.

Referring still to FIG. 6, magnetic member 34*a* is generally shaped to be received within a cavity formed by coil 24 and forms an opening in a lower surface for receiving an upper end of plunger 34*b*. Plunger 34*b* is an elongated member that includes a distal end 97 that extends from member 34*a*. A pin 53 or the like passes through apertures 89*a* and 89*b* and similarly sized openings formed in member 34*a* and plunger 34*b* to secure extensions 34*c* and 34*d*, member 34*a* and plunger 34*b*. Lower ends 87*a* and 87*b* of members 35*a* and 35*b* form apertures 89*a* and 89*b*.

Referring still to FIG. 6, member 34*a* is received within coil 24 and is biased downward by spring 51. The lower end of plunger 34*b* is mounted to a yoke that carries the movable contacts of normally open contactors 26, 28, 30 and 32. For example, in FIG. 6, contactor 26 includes a stationary contact 49 and a movable contact 47 where movable contact 47 is carried by the yoke that is rigidly attached to the distal end of plunger 34*b*.

Figure 7:
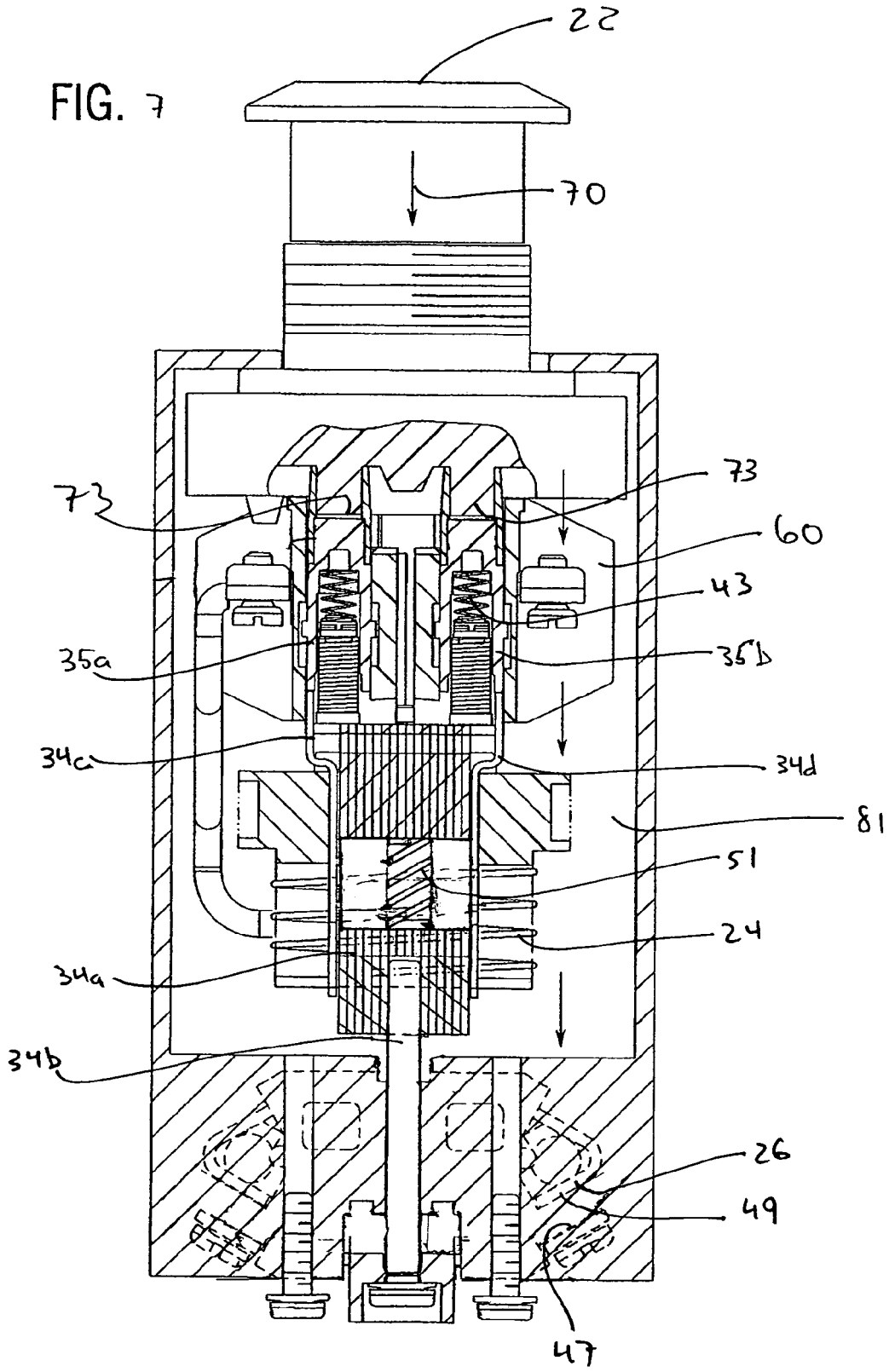
FIG. 7 is similar to FIG. 6, albeit illustrating the module components when the emergency stop button 20 is pressed.

Referring still to FIG. 6, when coil 24 is energized, member 34*a* and plunger 34*b* are pulled upward which in turn causes the normally open contacts in block 79 to close. When button 22 is pressed as indicate by arrow 70, the emergency stop contacts (not illustrated in FIGS. 6-7) are opened. In addition, referring to FIG. 7, the lower ends of extension members 35*a* and 35*b* contact the upper ends of extensions 34*c* and 34*d* and, through extensions 34*c* and 34*d*, force magnetic member 34*a* and plunger 34*b* downward. As illustrated in FIG. 7, when plunger 34*b* moves downward, the normally open relay contactors (e.g., 26) are opened. When button 22 is released, springs 43 forces extension members 35*a* and 35*b* to follow button 22 while spring 51 maintains member 34*a*, plunger 34*b* and the relay contactors in the normally open state. Here, until the relay contactors are again closed, the upper ends of extensions 34*c* and 34*d* will be separated from the lower ends of members 35*a* and 35*b*. However, once the emergency stop contactors again close and magnetic member 55 is forces upward, extensions 34*c* and 34*d* are also forced upward until the top ends thereof contact the lower ends of members 35*a* and 35*b*.

Figure 8:
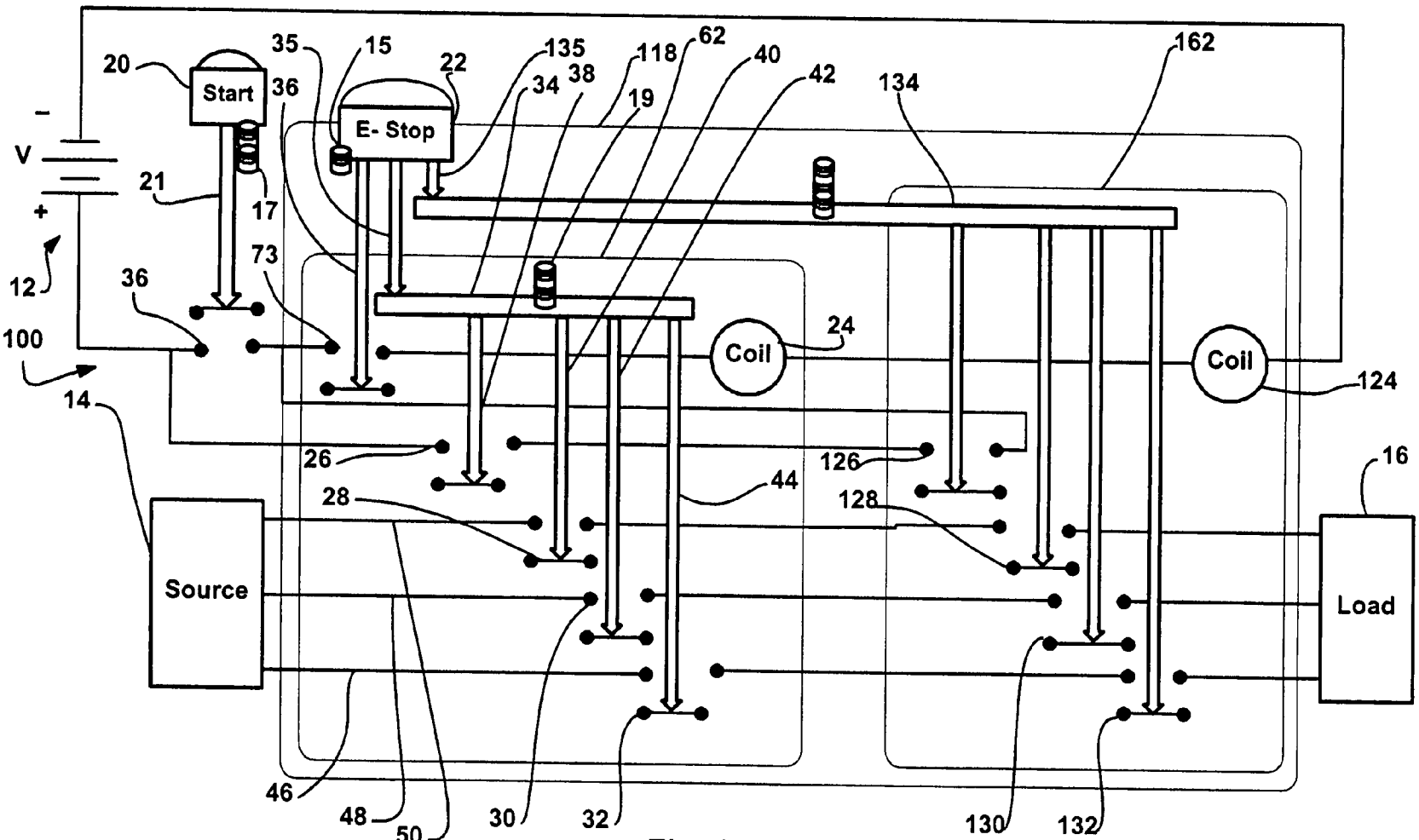
FIG. 8 is similar to FIG. 1, albeit illustrating another emergency stop/relay module embodiment that includes two relays.

Referring now to FIG. 8, another exemplary power control system 100 that is consistent with at least some aspects of the present invention is illustrated. In FIG. 8, many of the components illustrated are similar to the components described above and are therefore identified by similar numbers. For instance, the start button in FIG. 8 is identified by numeral 20. Similarly, the three-phase power source is identified by numeral 14 in FIG. 8 as is the source in each of FIGS. 1-3 above.

The main difference between system 100 and the system described above with respect to FIGS. 1-3 is that the emergency stop/relay module 118 in FIG. 8 includes two separate four contactor relays instead of a single relay so that additional redundancy can be provided via an assembly located within a single housing. To this end, in addition to the relay 62 described above, emergency stop/relay module 118 includes a second relay 162 including a second relay coil 124, a second relay armature 134 and first through fourth normally open contactors 126, 128, 130 and 132. Here, relay contactor 126 is linked in series with contactor 26 and both of those contactors are in parallel with the start contactor 36. Contactor 128 is in series with contactor 28 between source 14 and load 16. Similarly, contactors 30 and 130 are in series between the source and load while contactors 32 and 132 are in series between the source and load.

Referring still to FIG. 8, the start-stop circuit includes start contactor 36 in series with emergency stop contactor 73, coil 24, second relay coil 124 and control voltage source 12. As illustrated, armature 134 is movable to open and close the second relay contactors 126, 128, 130 and 132. In addition, another extension member 135 is provided that extends from emergency stop button 22 and that contacts armature 134 when button 22 is pressed or when armature 134 is in the energized position. In FIG. 8, button 22 is shown pressed such that each of armatures 34 and 134 are in the deactivated positions and all of the relay coils are open.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. For example, while the invention is described in the context of a relay including four normally closed contactors, other relay types are contemplated. In addition, while several embodiments include a button for simultaneously controlling an emergency stop contactor and relay contactors, other embodiments are contemplated where a button is solely provided for manually opening relay contactors without affecting an emergency stop contactor. Moreover, other embodiments are contemplated wherein a relay contactor block may be sandwiched between an emergency stop button and an emergency stop contactor. The disclosure is intended to cover by the appended claims all such modifications as fall within the scope of the claims.

To apprise the public of the scope of this invention, the following claims are made:

What is claimed is:

1. A switching apparatus comprising:

a relay including a relay coil and at least one normally open relay contactor that closes when the relay coil is energized;

a normally closed stop contactor in series with the relay coil; and a stop member moveable between a deactivated position in which the stop contactor is closed and an activated position wherein the stop member mechanically forces each of the stop contactor and the relay contactor open.

2. The apparatus of claim 1 wherein the relay contactor is a first relay contactor and the relay includes at least a second normally open relay contactor.

3. The apparatus of claim 2 wherein the relay includes third and fourth normally open relay contactors.

4. The apparatus of claim 1 further including a housing forming a cavity and wherein the relay and the stop contactor are mounted within the cavity.

5. The apparatus of claim 4 wherein the housing forms an opening and wherein the stop member includes a distal end that extends from the opening, when the distal end is pressed, the stop member moving form the deactivated position to the activated position.

6. The apparatus of claim 5 wherein the distal end forms a button surface.

7. The apparatus of claim 1 for use with a power supply, a load and a start assembly, the apparatus for controlling power provided by the supply to the load via at least one power line, the start assembly including a start member and a normally open start contactor, the first relay contactor linked within the at least one power line between the source and the load, the stop contactor linked in series with the start contactor and the second relay contactor linked in parallel with the start contactor.

8. The apparatus of claim 1 wherein the relay is a first relay and the apparatus further includes a second relay including a second relay coil and at least one normally open second relay contactor that closes when the second relay coil is energized, the stop member, when moved to the activated position, also forcing the second relay contactor open.

9. A switching apparatus for use with a three phase power supply, a three phase load and a start assembly where each load phase is linked to a separate one of the supply phases via a unique power line, the apparatus for controlling power provided by the supply to the load via at least one power line, the apparatus comprising:

a relay including a relay coil and at least one normally open relay contactor that closes when the relay coil is energized;

a normally closed stop contactor in series with the relay coil; and a stop member moveable between a deactivated position in which the stop contactor is closed and an activated position wherein the stop member mechanically forces each of the stop contactor and the relay contactor open;

the start assembly including a start member and a normally open start contactor, the first relay contactor linked within the at least one power line between the source and the load, the stop contactor linked in series with the start contactor and the second relay contactor linked in parallel with the start contactor; and third and fourth normally open power contactors linked within the second and third power lines between the source and the load, respectively.

10. A switching apparatus comprising:

a relay including a relay coil and at least one normally open relay contactor that closes when the relay coil is energized;

a normally closed stop contactor in series with the relay coil; and a stop member moveable between a deactivated position in which the stop contactor is closed and an activated position wherein the stop member mechanically forces each of the stop contactor and the relay contactor open;

wherein the relay includes an armature that moves along an activation axis when the coil is energized and de-energized, the at least one relay contact linked to the armature to move therewith between the closed and open states, the stop member including a proximal end that bears against at least one of the armature and the stop contact when in the activated position.

11. The apparatus of claim 10 wherein the proximal end of the stop member bears against the armature when the stop member is in the activated position.

12. The apparatus of claim 11 wherein the stop member includes a coupler that engages the stop contact when the stop member is in the activated position.

13. The apparatus of claim 10 wherein the stop member includes a distal end opposite the proximal end and wherein the stop contactor is positioned between the distal end and the relay.

14. An assembly for use with a power supply and a load, the assembly for controlling power provided by the supply to the load via at least one supply line, the assembly comprising:

a relay including a relay coil and at least a first normally open relay contactor that closes when the relay coil is excited, the relay contactor positioned within the line between the source and the load;

a normally closed stop contactor in series with the relay coil; and a stop member moveable between a deactivated position in which the stop contactor is closed and an activated position wherein the stop member mechanically forces each of the stop contactor and the relay contactor open via a mechanical linkage between the stop member and the relay contactor and between the stop member and the stop contactor.

15. The assembly of claim 14 also for use with a start assembly including a start member and a normally open start contactor that closes when the start member is pressed, the stop contactor linked in series with the start contactor, the relay including at least a second normally open relay contactor, the second contactor linked in parallel with the start contactor.

16. An assembly for use with a three phase power supply, a three phase load and a start assembly including a start member and a normally open start contactor that closes when the start member is pressed where each load phase is linked to a separate one of the supply phases via a unique power line, the assembly for controlling power provided by the supply to the load via at least one supply line, the assembly comprising:

a relay including a relay coil and at least a first normally open relay contactor that closes when the relay coil is excited, the relay contactor positioned within the line between the source and the load;

a normally closed stop contactor in series with the relay coil and in series with the start contactor; and a stop member moveable between a deactivated position in which the stop contactor is closed and an activated position wherein the stop member mechanically forces each of the stop contactor and the relay contactor open via a mechanical linkage between the stop member and the relay contactor and between the stop member and the stop contactor; and third and fourth normally open power contactors linked with the second and third power lines between the source and the load, respectively.

17. A switching apparatus comprising:

a rigid support structure;

a relay mounted within the support structure, the relay including a relay coil, an armature and at least one normally open relay contactor, the contactor including at least one moveable contact and one stationary contact, the moveable contact mounted for movement to the armature, the armature and moveable contact moving between a de-energized position and an energized position along an armature axis when the coil is energized and de-energized, respectively, the moveable contact closed with the stationary contact when the armature is in the energized position;

a normally closed stop contactor mounted within the support structure, the stop contactor including at least one moveable contact and at least one stationary contact; and a stop button mounted to the support structure for movement between an activated position and a deactivated position along a stop axis that is substantially parallel to the armature axis, the stop button operably juxtaposed with respect to each of the stop contactor and the armature such that, with the armature in the energized position, when the stop button is activated, the stop button contacts the armature and opens each of the stop contactor and the normally open relay contactor.

18. The apparatus of claim 17 wherein the relay includes at least second, third and fourth normally open relay contactors that open and close along with the first normally open relay contactor.

19. A switching apparatus comprising:

a relay including a relay coil and at least one normally open relay contactor that closes when the relay coil is energized; and a manual open button moveable between a deactivated position in which the button is mechanically disconnected from the relay contactor and an activated position wherein the button forces the relay contactor open.

20. The apparatus of claim 19 further including a housing that forms a cavity and at least one opening into the cavity, the relay mounted within the cavity and the button mounted within the opening.

21. The apparatus of claim 19 further including a normally closed stop contactor supported proximate the relay wherein when the button is deactivated the stop contactor is closed and when the button is in the activated position the stop member forces each of the stop contactor and the relay contactor open.

22. A method for cutting off power from a source to a load when a stop button is activated, the method comprising the steps of:

providing a normally closed emergency stop contactor that is mechanically linked to the stop button such that when the stop button is activated, the stop contactor is opened; and providing a relay including a coil in series with the stop contactor and at least one relay contactor in series between the source and the load wherein the relay contactor is mechanically linked to the stop button such that when the stop button is activated, a mechanical force is applied from the stop button to the relay contactor so that the relay contactor is opened.

* * * * *